US005839630A

United States Patent [19]

Dunstan et al.

[11] Patent Number: 5,839,630

[45] Date of Patent: Nov. 24, 1998

[54] BATON HOLDER

[76] Inventors: Jacqueline M. Dunstan; Gary M. Grundy, both of 604 Aspen St., South Milwaukee, Wis. 53172

[21] Appl. No.: 954,502

[22] Filed: Oct. 20, 1997

[51] Int. Cl.[6] ..... A45F 5/00

[52] U.S. Cl. ..... 224/197; 224/251; 224/242; 224/675; 224/901.4

[58] Field of Search ..... 224/197, 251, 224/200, 675, 674, 242, 250, 901.4

[56] References Cited

U.S. PATENT DOCUMENTS

| | | |
|---|---|---|
| D. 280,256 | 8/1985 | Miller . |
| D. 283,633 | 4/1986 | Nichols . |
| D. 347,522 | 6/1994 | Beltran . |
| 3,977,582 | 8/1976 | McMahon . |
| 4,006,851 | 2/1977 | Kippen . |
| 4,020,985 | 5/1977 | Halterman . |
| 4,384,372 | 5/1983 | Rector . |
| 4,424,923 | 1/1984 | Bingham . |
| 4,662,552 | 5/1987 | Uyehara . |
| 4,694,981 | 9/1987 | Miller, Jr. . |
| 4,953,769 | 9/1990 | Parsons et al. . |
| 4,955,518 | 9/1990 | Parsons et al. . |
| 5,022,575 | 6/1991 | McDonald . |
| 5,108,098 | 4/1992 | Ashihara . |
| 5,160,140 | 11/1992 | Starrett . |
| 5,217,151 | 6/1993 | Parsons . |
| 5,263,619 | 11/1993 | Shoemaker . |
| 5,441,187 | 8/1995 | Mixson . |
| 5,449,104 | 9/1995 | Parsons . |
| 5,551,610 | 9/1996 | Clifton, Jr. . |

*Primary Examiner*—Linda J. Sholl

[57] ABSTRACT

A baton holder for a side-handled baton is disclosed including a belt loop for wrapping around the user's belt and a pivotable baton holster attached to the belt loop by a swivel. The belt loop includes a handle cradle for cradling the side handle of the side-handled baton and a shaft cradle for cradling the shaft of the side-handled baton. The baton is held within the baton holster by a pair of tabs extending up from the handle cradle that are secured with both a snap and a hook and loop connector.

7 Claims, 2 Drawing Sheets

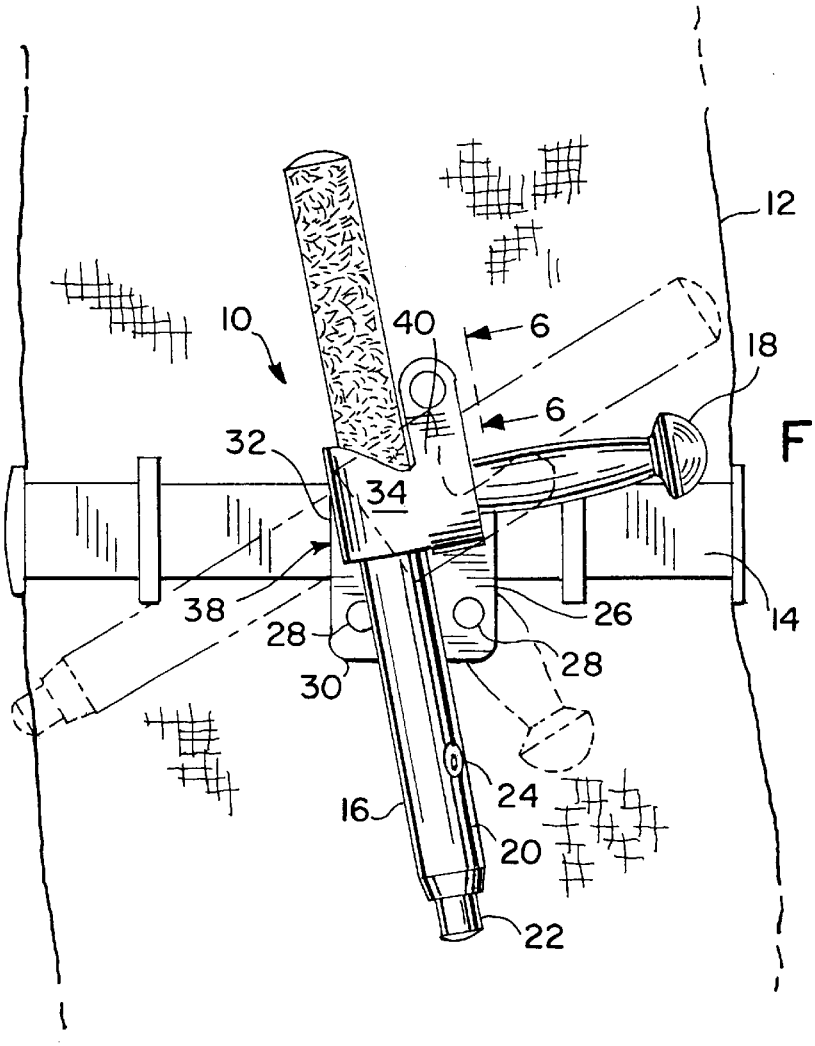
FIG. 1
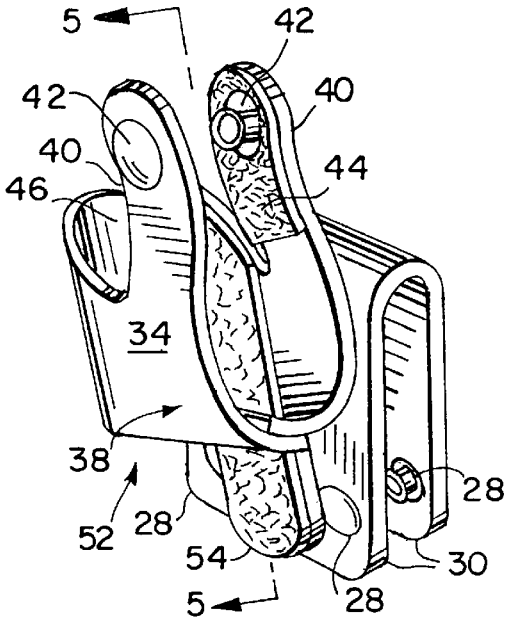
FIG. 3
FIG. 2
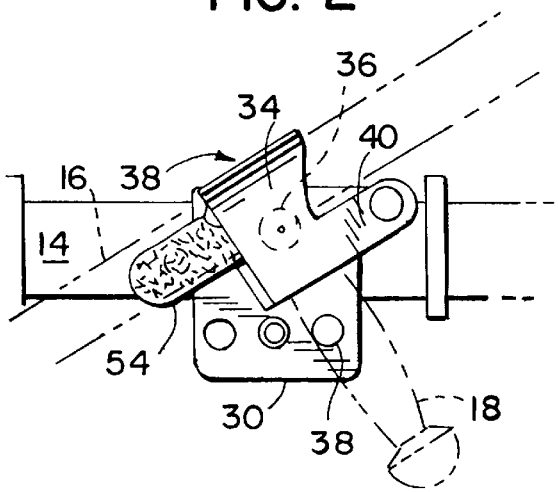

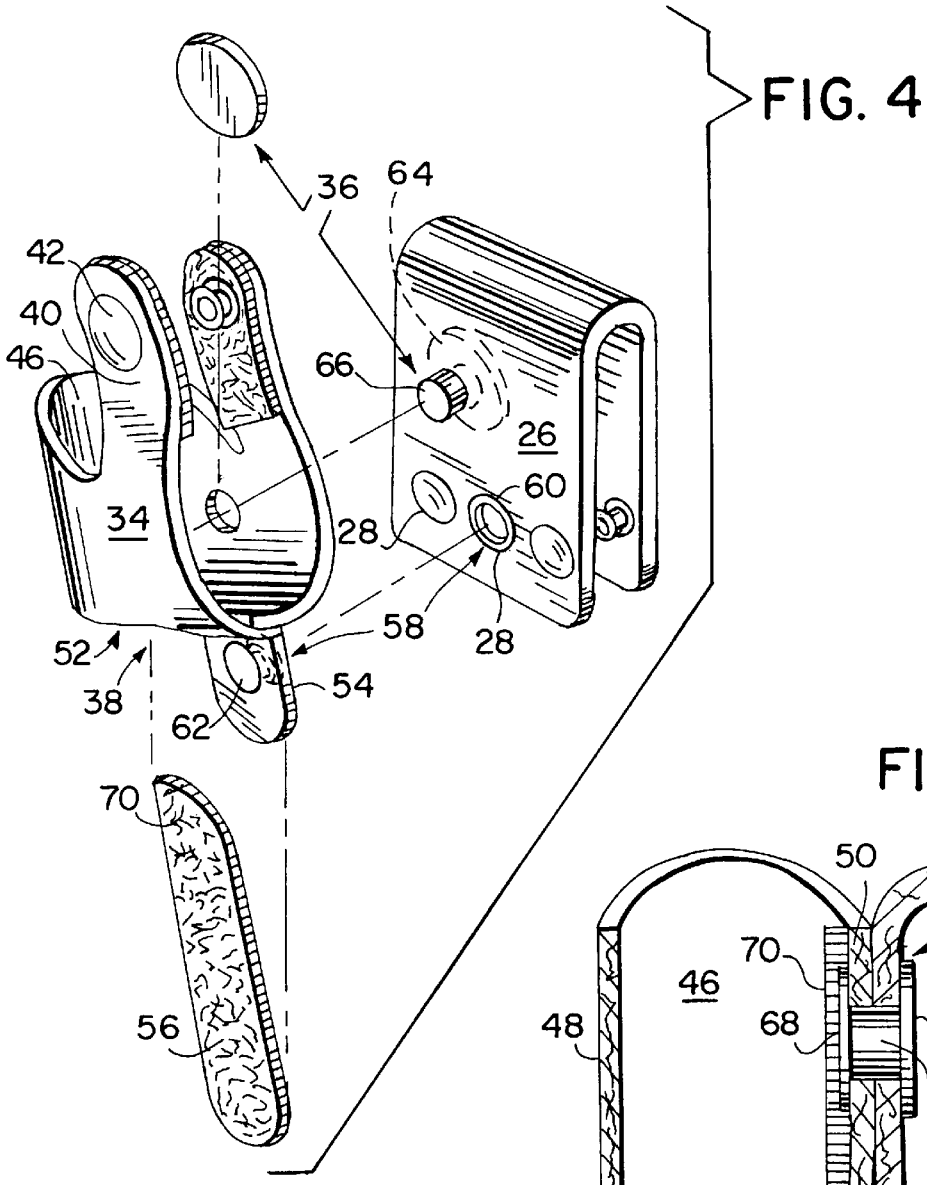
FIG. 4
FIG. 5
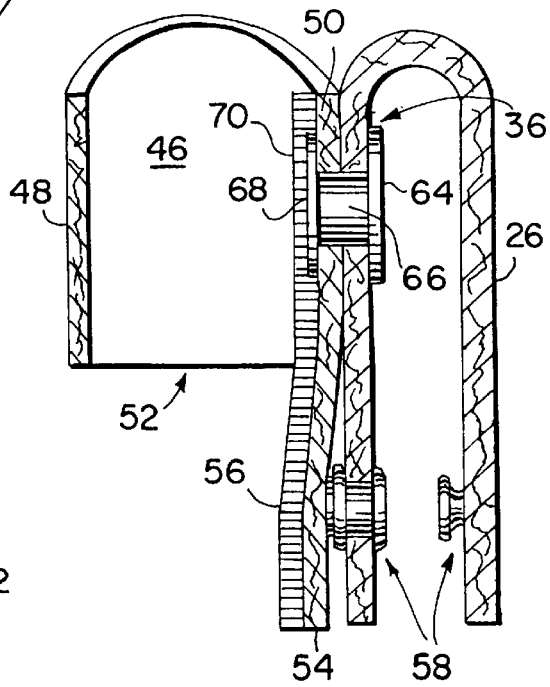
FIG. 6
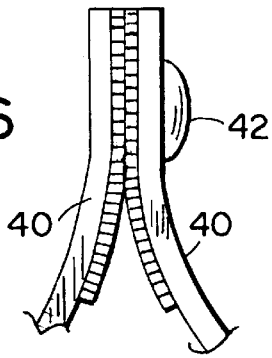

BATON HOLDER

FIELD OF THE INVENTION

This invention relates generally to belt-mounted holders for carrying equipment on a user's body. More particularly, it relates to holders for carrying self-defense devices.

BACKGROUND OF THE INVENTION

Security personnel such as policemen often carry a variety of equipment strapped to their body, such as radios, guns, batons, chemical sprays and the like. For some of these devices it is important that the mode of support allows for quick, often one-handed deployment, when confronting and dealing with a threatening situation. The need for quick and easy deployment is balanced by an opposing need to prevent others from taking the equipment from the police officer and using it against him. In addition, items such as batons or night sticks must be carried so that they do not interfere with the policeman's freedom of movement, or prevent him from engaging in activities such as sitting down in a police car.

One purpose of this invention is to provide an improved holder for a side-handled baton that addresses these needs.

SUMMARY OF THE PRESENT INVENTION

A first embodiment of this invention is a side-handled baton holder having a belt loop and a side-handled baton holster joined by a swivel. The belt loop drapes over the user's belt and is maintained on the belt by securing the two ends of the loop together around the belt using two snaps fixed to the lower edges of the loop. The holster has a cradle for supporting the handles of the side-handled baton including two tabs, one extending upward from each side of the cradling portion that snaps together around the top of the handle to keep the handle from being easily lifted out. The tabs are equipped with a snap and Velcro to keep them together. A second cradle, in the form of a strap extending around the shaft of the baton is fixed to each side of the handle cradle and supports the shaft of the baton. The shaft of the baton extends downward out of a hole at the bottom of the holster.

Other principal features and advantages of the invention will become apparent to those skilled in the art upon review of the following drawings, the detailed description and the appended claims.

BRIEF DESCRIPTION OF THE DRAWINGS

FIG. 1 illustrates a first embodiment of the invention in two positions as carried on the waist of a user;

FIG. 2 illustrates the baton holder of FIG. 1 in a second position;

FIG. 3 is a perspective view of the baton holder of FIG. 1;

FIG. 4 is an exploded view of the baton holder of FIG. 1;

FIG. 5 is a sectional view of the baton holder of FIG. 1; and

FIG. 6 is a detail view of the tabs of the baton holder of FIG. 1.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

FIG. 1 illustrates the baton holder 10 as typically worn by a police officer 12 depending from the officer's belt 14. The holder supports a side-handled baton 16, called a side-handled baton because it has a handle 18 extending outward at a right angle from the side of the baton shaft 20 at a point approximately seven inches from the uppermost end of the baton shaft. The traditional baton is simply an elongate shaft without an additional handle. Note that the baton, when carried in the baton holder on the hip of an erect officer as shown in FIG. 1 extends substantially vertically, although with a slight top-forward tilt to the baton of about 5–8 degrees. The handle extends backward toward the officer's posterior. This is the preferred position for walking and standing. A feature of the baton is that it is expandable in length to approximately double the length shown here. Additional details on the baton construction are shown in U.S. Pat. No. 5,160,140. The baton can be extended by grasping the handle and swinging the baton through the air. An internal baton shaft 22 will slide out of the shaft of the baton and lock in position when a spring-loaded detent (not shown) on the internal shaft 22 snaps into opening 24, preventing both the further outward or inward travel of inner shaft 22 with respect to shaft 20 until the user presses detent back into opening 24, unlocking the internal shaft and allowing it to be pressed back into shaft 20.

The baton holder comes in two portions coupled together by a swivel. The first portion is the belt loop 26, which wraps downwardly around both the inside and the outside of the officer's belt 14, and extends below the officer's belt to allow snaps 28 on the lower portion 30 of the belt loop 26 to be snapped closed thereby holding the lower portions 30 of the belt loop 26 together and preventing a suspect from merely lifting the baton (and baton holder) off the officer's belt. Alternatively, if a more secure attachment to the belt is desired, the ends of the loop may be permanently joined by sewing or riveting or both. To further reduce the risk of someone removing the baton holder, these two snaps 28 are of the one-directional variety, such as the "pull-the-dot" snap sold by Scovill, which can be opened only by pulling them apart in one direction. In the present application, they would be oriented when attached to the belt loop so that they could be unsnapped by grasping the lower portions 30 of the two halves of the belt loop 26 below the snaps and pulling them apart. To unsnap the snaps and remove the belt loop, the officer could reach down, grasp the lower portion 30 of the outer half of belt loop 26, and pull it away from his body. Conversely, a person interfering with the officer and attempting to remove the baton holder would be more likely to slide his fingers along the belt, grasp the belt loop at a midpoint 32 and pull outward. This, however, would not release the one-directional snaps and the attempt would fail.

The second portion is a baton holster 34 which is attached to the belt loop 26 by a swivel 36 that allows the holster 34 to rotate with respect to the belt loop 26 while the baton holster 34 is still attached to the belt loop. In this manner, the officer can rotate the bottom of the baton forward perhaps 90 degrees to allow him to sit comfortably in an automobile. This is a particularly important feature for use with collapsible batons, which, due to their short length, can be swiveled forward far enough to allow sitting in an automobile.

A preferred mode of using such a collapsible side-handled baton has been developed for which the present baton holder is also well-adapted. In particular, the officer releases a snap (not shown) that maintains the baton in its 5–8 degree top-forward position shown in solid lines in FIG. 1, and allows him to swivel the top of the baton backwards toward his posterior to a preferred top-backward position as shown in dotted lines in FIG. 1. In this position, he can reach around behind himself with what would be his right hand in the FIG. 1 embodiment, grasp the top of the baton with his right hand, and remove the baton. Due to the collapsible baton's relatively short length, this maneuver can be performed easily and rather stealthily. Once removed, the officer can then hold the baton by its side handle at his right side, or perhaps hidden behind his right leg as he confronts a suspect. By removing the baton behind his back and holding it at his side, he does not exacerbate a situation by unduly threatening a potential suspect, but also has the baton at the ready if threats are imminent. By reaching around and removing the baton as described above, the baton rests in his hand with shaft 20 at the index finger side of his fist (e.g. in the same position as the barrel of a hand gun would be if held in a firing position).

If the officer senses danger, he can simply swing his right arm forward with some outward extension. This motion will cause the baton to turn in his hand, the inner shaft to slide out due to centrifugal force and be locked in position. Although the deployment of the baton has been described in the case when the baton is held on the officer's left hip and is deployed in the right hand, it is obvious that the same operation could be performed by locating the baton holder on an officer's right hip and deploying the baton in the officer's left hand.

Holster 34 includes a handle cradle 38 for supporting the baton handle 18 in the holster. There are two tabs 40 (one shown in FIG. 1) that extend upward from the handle cradle 38, one on each side of the handle 18, and terminate above the handle 18 having a length sufficient to allow them to be secured together with a snap 42 in conjunction with hook-and-loop fastener material 44 (FIG. 6) to thereby surround the handle 18 and prevent it from slipping upward out of the baton holder, such as when the officer sits down. As best seen in FIG. 6, a patch of hook material 44 is attached to a baton-facing side of one of the tabs and a patch of loop material 44 is attached to a baton-facing side of the other of the tabs. When the patches are attached to the tabs in this manner, the baton acts to pull the two tabs apart when the baton is lifted upwards with respect to the baton holster. The material thickness of the flaps and the gripping strength of the snap are selected to allow the baton to be grasped by the officer and lifted out of the holster without first pulling the tabs apart. This allows the baton to be held firmly against accidental dislodgement during the officer's normal daily activities, but also to allow the baton to be quickly removed with one motion of a single hand when the baton is needed in an emergency, such as in the behind-the-back deployment process described above. The hook-and-loop fastener material has a fairly limited resistance to the separation forces exerted by an officer who pulls the baton upwards. The stresses generated by this motion can be considered as "peeling" the two flaps apart. The hook-and-loop material has a significant resistance to shear forces acting on the two tabs, i.e. the relative sliding of the two tabs with respect to each other. In contrast to this resistance, the snap coupling the two flaps provides a relatively predictable and high resistance to a peeling force but is less resistant to shear forces. Shearing stresses applied to two flaps fastened with a snap alone may therefore cause the snap to open prematurely or cause the snaps to become loose on their respective flaps. By combining both a snap and hook-and-loop fastener adjacent to each other, both shearing and peeling forces can be resisted while still allowing the user to remove the baton with a pull even when the tabs are coupled to each other.

The holster also includes a shaft cradle 46 that supports the shaft. As best seen in FIG. 3, the shaft cradle is in the form of a flap of material coupled at a first end 48 to the handle cradle on the side of the handle cradle facing away from the belt loop, having an elongate extent looping around the shaft, and having a second end 50 coupled to the handle cradle on the side of the handle cradle closer to the belt loop. At a lower edge of the shaft cradle 46 is an opening 52 which is provided to allow a lower portion of the baton to pass through the opening as shown in FIG. 1. The holster further includes an elongate finger 54 extending downward from the opening 52. The finger 54 is dimensioned and oriented with respect to the holster such that it is interposed between the baton shaft and the belt loop when a side-handled baton is inserted into the holster as best seen in FIG. 2. It preferably extends to the bottom of the belt loop (see FIG. 5) when the holster is fastened in position. It is further dimensioned to be disposed between the shaft and snaps 28 of the belt loop when the holster is unsnapped and rotated about the belt loop (see FIG. 2). The finger is preferably lined with a friction-reducing material 56 such as felt, a flocked fabric or a loop fabric such as the loop fabric portion of a hook-and-loop fastener. Friction-reducing material 56 preferably has an adhesive backing which will allow it to be easily attached and removed from finger 54 for periodic replacement. By lining the finger with this material on the side of the finger facing the baton shaft, the baton shaft does not rub against the belt loop when the baton holster is rotated and therefore does not bind against the belt loop when the holster is unsnapped and the baton deployed.

A fastener 58, preferably a snap fastener or a hook-and-loop fastener, is provided to couple the holster to the belt loop and to prevent the holster from freely rotating about the belt loop-holster swivel 36 when the officer is about his routine duties. This fastener, best shown in FIGS. 2, 4 and 5 has a first piece 60 fixed to belt loop 26 and a second piece 62 fixed to holster 34 at a lower portion of finger 54. These two pieces, when fastened together, couple holster 34 to belt loop 26 and prevent holster 34 from rotating freely about swivel 36 with respect to belt loop 26.

As best shown in FIG. 5, swivel 36 couples holster 34 to belt loop 26 allowing holster 34 to swivel or rotate with respect to belt loop 26. It includes a first plate 64 coupled to a first end of shaft 66, and a second plate 68 coupled to a second end of shaft 66. The first plate 64 is disposed on a belt facing surface of belt loop 26 and the second plate 68 is disposed on a baton facing surface of holster 34. A friction reducing material 70 covers an otherwise free surface of second plate 68 and is disposed between the baton shaft 20 and second plate 68 when the baton is installed in the holder. This friction reducing material 70 can be either a separate piece, or (as shown here) may be integral with the friction reducing material that is disposed on the inside surface of finger 54. As with friction reducing material 56, the material 70 covering second plate 68 is preferably an adhesive-backed loop fabric for easy replacement.

The holder, both belt loop and holster are preferably made of a 5–12 ounce leather, more preferably 9–10 ounce leather. Equivalent materials having a similar stiffness and resilience are also acceptable. Such materials include plastic, Porvair, ballistic nylon, nylon laminate, Safari laminate, any of which (including leather) may be laminated to a stiffener layer made of a material such as Kydex, cardboard or steel.

Thus, it should be apparent that there has been provided in accordance with the present invention an improved baton holder that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A side-handled baton holder comprising:

a belt loop to loop around a service belt having first and second downwardly extending free ends secured together by a fastening means; and a holster rotatingly coupled to the belt loop to support a side-handled baton, the holster including, a handle cradle to support a side handle of the side-handled baton, a first tab coupled to and extending upwardly from an outer surface of the handle cradle, a second tab coupled to and extending upwardly from an inner surface of the handle cradle, a securing means coupled to the first and second tabs at an upper end thereof to provide when the securing means is in a secured position, a closed loop surrounding the handle together with the handle cradle and the first and second tabs, a shaft cradle to support the shaft of a side-handled baton in the form of a loop coupled to and extending from an outer edge of the handle cradle to an inner edge of the handle cradle and having an opening at a lower edge thereof to allow a lower portion of the baton to pass through; and a swivel coupled to an inner surface of the baton holster and an outer surface of the belt loop to couple the baton holster and belt loop while providing relative rotational movement of the two.

2. The side-handled baton holder of claim 1 wherein the securing means includes a snap.

3. The side-handled baton holder of claim 2 wherein the securing means includes a hook-and-loop fastener disposed on an outer surface of the first and second tabs.

4. The side-handled baton holder of claim 3 wherein the portion of the shaft cradle would abut a portion of the baton shaft opposite the baton handle.

5. The side-handled baton holder of claim 4 further comprising an elongate member coupled to and extending downwardly from the shaft cradle.

6. The side-handled baton holder of claim 5 wherein the elongate member extends at least as far as a lowermost extent of the first and second snaps.

7. The side-handled baton holder of claim 6 wherein the first and second snaps are one-directional snaps.

* * * * *